US005666673A

United States Patent [19]

Ammatelli et al.

[11] Patent Number: 5,666,673

[45] Date of Patent: Sep. 16, 1997

[54] TOILET SEAT

[76] Inventors: Francis J. Ammatelli, 1235 W. 57th Ter., Kansas City, Mo. 64113; Edward L. McMullen, 10004 Walnut Dr., Kansas City, Mo. 64114

[21] Appl. No.: 605,349

[22] Filed: Feb. 22, 1996

[51] Int. Cl.[6] ..... E03D 11/00

[52] U.S. Cl. ..... 4/254; 4/237; 297/335

[58] Field of Search ..... 4/237, 254, 667, 4/241; 297/313, 323, 335, 423.1

[56] References Cited

U.S. PATENT DOCUMENTS

| | | | |
|---|---|---|---|
| 559,304 | 4/1896 | Muckenhirn . | |
| 906,053 | 12/1908 | McAuliffe . | |
| 2,667,802 | 2/1954 | Harris . | |
| 2,698,440 | 1/1955 | Lyons . | |
| 2,954,566 | 10/1960 | Lottenberg . | |
| 3,383,714 | 5/1968 | Minasian et al. . | |
| 4,175,294 | 11/1979 | Boyd | 4/237 |
| 4,254,514 | 3/1981 | Sakamoto . | |
| 4,466,140 | 8/1984 | Sakamoto . | |
| 4,742,659 | 5/1988 | Meilleur . | |
| 4,993,085 | 2/1991 | Gibbons | 4/237 |
| 5,311,617 | 5/1994 | Ammatelli et al. . | |

OTHER PUBLICATIONS

"Auxiliary Toilet Seat for Physically–Impaired Users", International Application No. PCT/US90/06344, International Filing Date Oct. 31/1990, International Publication Date May 16, 1991, Int'l Publication No. WO 91/06239, Applicant: Steven Greenberg.

*Primary Examiner*—David J. Walczak

*Attorney, Agent, or Firm*—Chase & Yakimo

[57] ABSTRACT

A toilet seat structure having a support framework for placement atop a conventional toilet bowl. A cradle assembly presents a pair of triangularly-shaped side panels which pivotally and tangentially engage laterally spaced-apart rails extending along each side of the toilet bowl. Spanning the side panels are a front lift bar and a conventional toilet seat. User induced pressure on the lift bar positions the lift bar at the front of the bowl with the seat being presented at an angled position to allow user entry. Downward pressure on the seat causes the toilet seat to assume a functional horizontal position above the toilet bowl. Concurrently, the lift bar swings upwardly so as to draw the legs of the seated user towards the user's torso. At this position the user is in an enhanced "squatting" position which is said to be effective for bowel movement. Alternative embodiments of the cradle assembly, associated rails, side arms and support framework are shown. The positions of the lift bar and the toilet seat at its horizontal position are adjustable to allow the structure to be adapted for use by various users.

20 Claims, 5 Drawing Sheets

Fig. 12
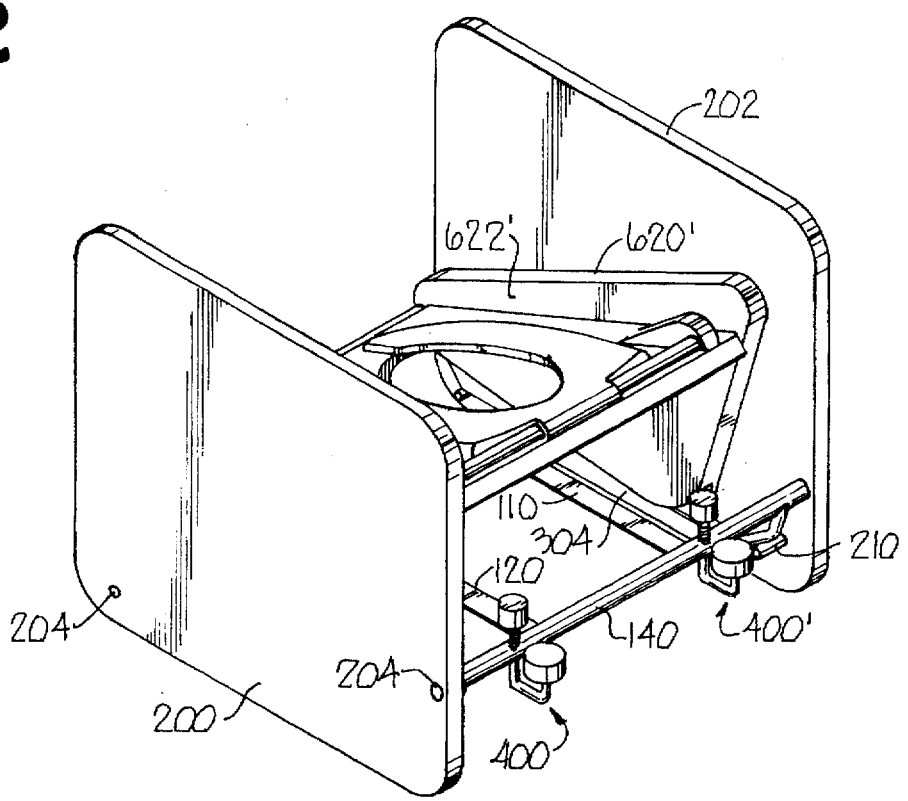
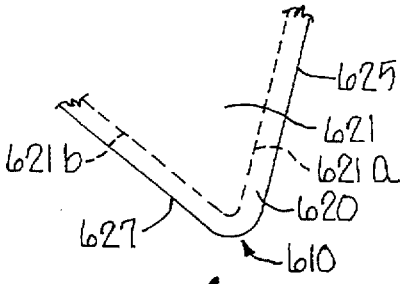
Fig. 20

Fig. 13
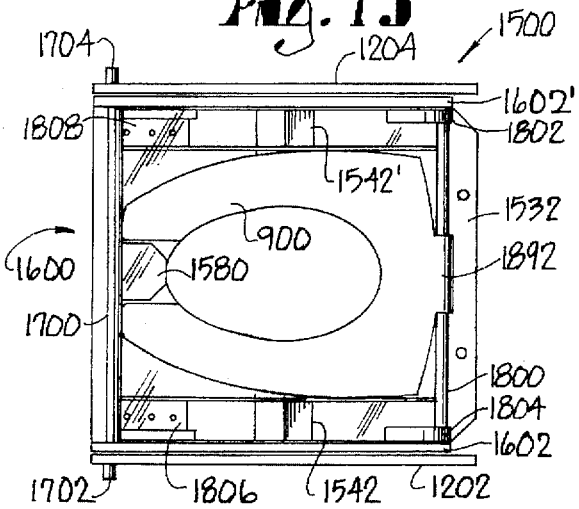
Fig. 14
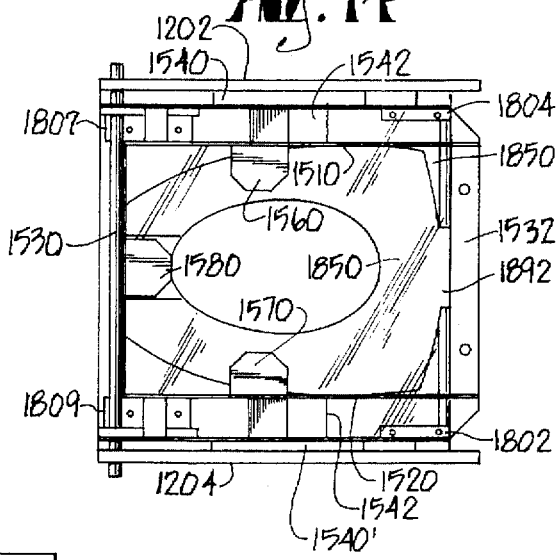
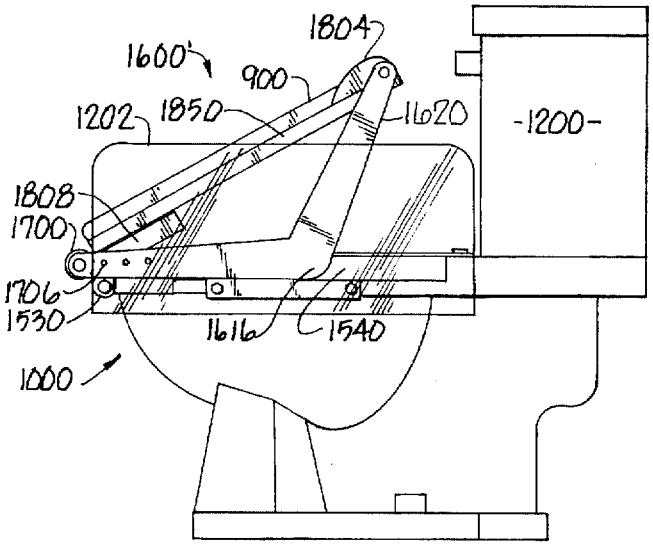
Fig. 15
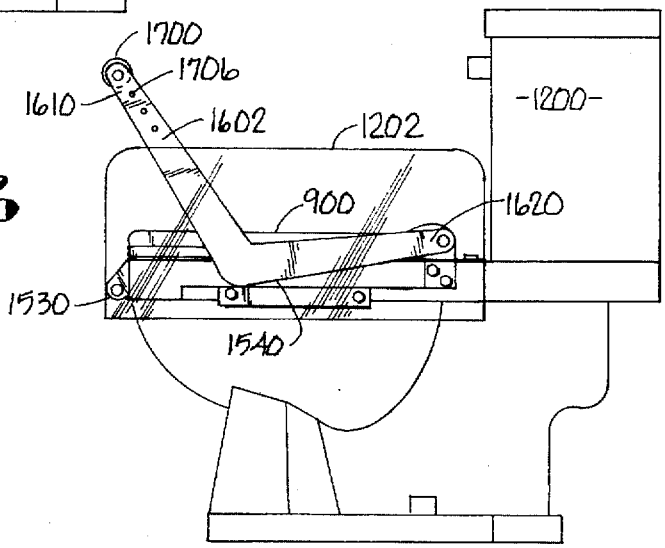
Fig. 16

TOILET SEAT

BACKGROUND OF THE INVENTION

This invention relates to a toilet seat device for use with a conventional toilet bowl, the device supporting the user in an effective bowel movement position.

It is generally accepted that the "squatting" position is an effective position for evacuating the bowels. Accordingly, devices have arisen to facilitate a seated user, particularly one with constipation, to assume a "squatting" position, one such device as shown in our U. S. Pat. No. 5,311,617, issued on May 17, 1994.

Seeking an improved structure to position the upper legs of a seated user adjacent the torso, we have invented a toilet seat device for use with a conventional toilet bowl. Our device enables the user to achieve a "squatting" position which facilitates bowel movement. The structure presents a support framework which is readily associated with a conventional toilet bowl having the conventional seat removed. A cradle assembly for a toilet seat includes a pair of panels which engage a pair of laterally spaced-apart rails, each rail positioned on one side of the toilet bowl. Each rail provides a fulcrum for pivotal and tangential movement of the side panels relative thereto. A conventional toilet seat is supported by the cradle assembly and is user operable between a conventional, horizontal position atop the underlying bowl and a second position in which the seat is angled relative to the underlying toilet bowl, the latter position being user entry and exit positions.

Concurrently movable with the cradle assembly is a lift bar underlying the seated user's upper legs which engages the legs when the seat is swung from an entry position to the conventional, horizontal position. Accordingly, the lift bar urges the upper legs of the user towards the seated user's torso so that the user's body assumes a constructive "squatting" position. This position straightens the colon, particularly the lower portion thereof, which is said to be an effective position for bowel evacuation.

Pressure of the "squatting" user's legs on the lift bar downwardly swings the lift bar and the user's legs to the floor. Concurrently, the rear of the seat will swing upwardly to the angled position, this position enabling the user to exit the toilet seat structure.

The movement of the toilet seat between the horizontal/functional and entry/exit positions is provided by pivotal and tangential movement of triangular side panels engaging the rails found in longitudinal extension on each side of the toilet bowl. The rail can take either a channel or tubular configuration. Upon pressure being applied on either the lift bar or toilet seat, the associated panels pivot and tangentially slide relative to the rail. This panel movement moves the associated lift bar and seat between their raised and lowered positions with the panel configuration being effective in maintaining such positions. The lift bar and associated side panels can be swung to a position displaced from the intermediate seat which allows the toilet to be accessed in a conventional manner.

Accordingly, it is a general object of this invention to provide a toilet seat which places the user at an enhanced position for bowel movement.

Still another object of this invention is to provide a device, as aforesaid, having a toilet seat swingably between horizontal and angled positions relative to the underlying toilet bowl proper.

A still further object of this invention is to provide a toilet seat, as aforesaid, having a cradle assembly including side panels which pivot and tangentially slide along a rail assembly to effect the toilet seat movement.

Still another object of this invention is to provide a toilet seat with lift bar, as aforesaid, the lift bar moving the user's upper legs towards the torso of a seated user.

A further object of this invention is to provide a toilet seat, as aforesaid, which presents a toilet seat and lift bar which are user movable between user entry, user seated and user exit positions.

Still another object of this invention is to provide a toilet seat, as aforesaid, the height of the toilet seat in the horizontal position being adjustable above the toilet seat rim.

A further object of this invention is to provide a toilet seat, as aforesaid, which is easily attached to a conventional toilet bowl or adaptable for use with an underlying waste container.

A more particular object of this invention is to provide a toilet seat, as aforesaid, which can be adapted for conventional use.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 12 is a rear, perspective view of the structure shown in FIG. 1 with the seat being in its user entry/exit position;

FIG. 13 is a top view of an alternative embodiment of the toilet seat structure;

FIG. 14 is a bottom view of the toilet seat structure of FIG. 13;

FIG. 15 is a side elevation view of the structure of FIG. 13 as installed on a toilet stool, the-seat being in an angled position with the lift bar being at its lowered position;

FIG. 16 is a side view of the toilet seat structure of FIG. 15 in a functional mode with the lift bar being in a raised position and the toilet seat being in a functional horizontal position;

FIG. 20 is a diagrammatic view of one of the side panels of the FIG. 1 structure and showing in phantom lines the intermediate core.

DESCRIPTION OF THE PREFERRED EMBODIMENT

Figure 1:
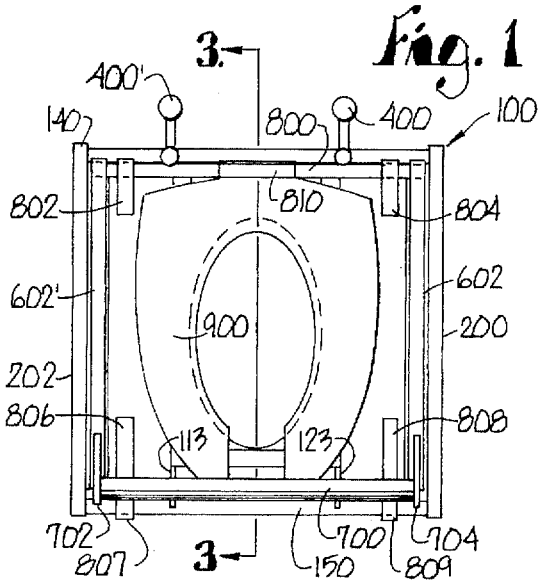
FIG. 1 is a top view of a first embodiment of the toilet seats
Figure 2:
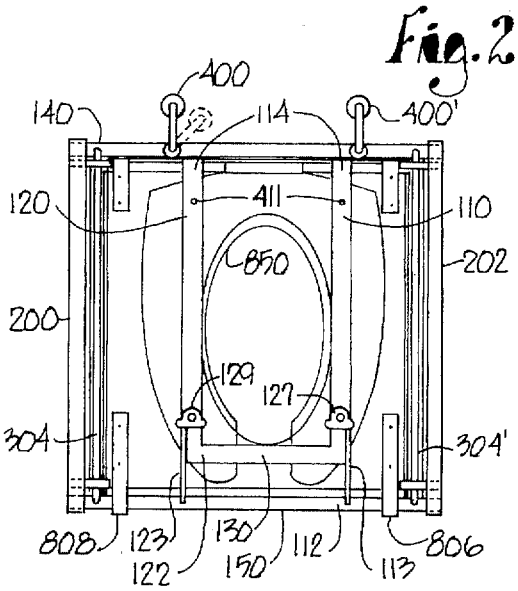
FIG. 2 is a bottom view of the toilet seat structure of FIG. 1.

Turning more particularly to the drawings, FIG. 1 illustrates a first embodiment 100 of our toilet seat structure as comprising a basic support frame having first and second longitudinal struts 110, 120, each strut having front 112, 122 and rear 114, 124 ends. A strut 130 transversely extends between the front ends of struts 110, 120. Brackets 113, 123 extend from the front ends 112, 122 of struts 110, 120 and are connected to a front, transverse support bar 150. Rubber spacers 127, 129 on the underside of struts 110, 120 engage the toilet bowl rim 1100 when the structure is atop the toilet bowl 1000.

Extending between the rear ends 114, 124 of struts 110, 120 is a rear, transverse support bar 140 for extension across the portion 1150 of the toilet bowl 1000 rim 1100 adjacent the water reservoir 1200. At the ends of transverse struts 140, 150 are attached a pair of Plexiglas® side panels 200, 202 for offering rigidity to structure 100. The panels 200, 202 are attached by means of bolts 204, 204*a* threadably engaging apertures presented by the open ends of the rear 140 and front struts 150. Bolts may also extend through panels 200, 200*a* and engage sockets 210, 210' attached to rails 304. These struts and bars 110, 120, 130, 140 form a frame designed to rest atop the rim 1100 of the conventional toilet bowl 1000 upon removal of the conventional toilet seat.

Figure 6:
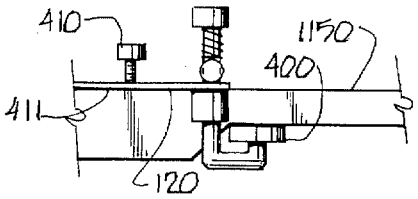
FIG. 6 illustrates the J-clamp of FIG. 5 in an engaged mode.
Figure 7:
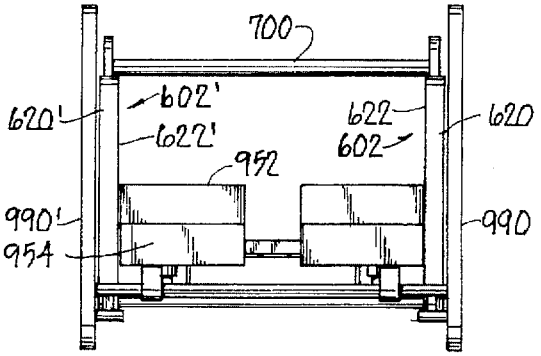
FIG. 7 is a front view of the apparatus of FIG. 1 with the seat in a horizontal position and lift bar in an elevated position, a substitute seat being shown.
Figure 8:
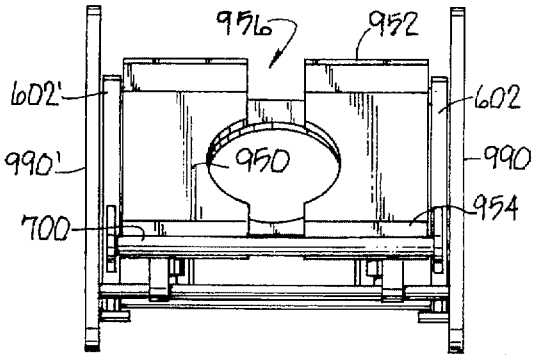
FIG. 8 is a front view of the apparatus of FIG. 7 showing the toilet seat in an angled entry/exit position with the lift bar in a lowered position, the toilet seat being of a split seat configuration to preclude discomfort to the user's tail bone.

Attached to the rear support bar 140 are a pair of J-clamps 400, 400' which are designed to engage the underside of the toilet bowl rim surface 1150 adjacent the water reservoir 1200 (FIG. 6).

Extending between the rear support bar 140 and front support bar 150 are a pair of rail assemblies generally designated as 300, 300'. (As the assemblies are similar in construction primed numbers are utilized to illustrate like components in assembly 300' with assembly 300 being described herein.) Each rail assembly 300, 300' comprises a longitudinally extending tubular rail member 304 with each member having angled ends 305, 306 connected to the rear support bar 140 and front 150 strut. Sockets 210, 212 are welded to these ends 305, 306 to present apertures for connecting bolts inserted through side support panels 200, 202. These rails are laterally spaced from the longitudinal struts 110, 120 at a width greater than the width of the conventional toilet bowl rim 1100.

A cradle assembly 600 includes a pair of laterally spaced-apart panel assemblies 602, 602'. (As the assemblies are similar in construction primed numbers are utilized to illustrate like components in assembly 602' with assembly 602 being described herein.) Each panel 602 comprises a pair of triangularly-shaped sidewalls 620, 622 with a smaller triangular core 621 sandwiched therebetween. As such, portions of the edges 625, 627 of the sidewall 620, 622 extend beyond the edges 621*a*, 621*b* of the intermediate core 621 as diagrammatically shown in FIG. 20. Such extension allows the sidewall edges to extend beyond the central portion 304 of rail 300 with the rail contacting the edges 621*a*, 621*b* of the displaced interior core 621. This combination presents a fulcrum-like zone 610 for pivotal and tangential movement of the panels 602, 602' relative to the respective rail 300, 300'.

A lift bar 700 extends between the front corners 642, of each panel assembly 602, 602'. The ends of the lift bar 700 are attached to arms 702, 704 which slidably extend between the sidewalls 620, 622 of each assembly 602, 602' and from a slot located in the intermediate core 621. The extension of the lift bar arms 702, 704 beyond the front corners 642 of the panels 602, 602' is adjustable by means of a dowel 706 extending between the sidewalls 620, 622 and engaging selected notches 708 on each arm 702, 704. Upon removal of the dowel 706 each arm may be selectably extended beyond corner 642. Upon reaching a desired arm 702, 704 extension, the dowel 706 is replaced so as to preclude further longitudinal movement of each arm 702, 704. This structure enables the lift bar 700 to be adjusted according to the length of the user's legs.

Extending between the rear corners 644 of the panels is a seat support bar 800. Attached to this bar 800 are support brackets 802, 804 which are screw attached to a rectangular sheet of Plexiglas® 850. At the front end of the Plexiglas® 850 are underlying brackets 806, 808 which are screw attached to the underside of the Plexiglas® 850. Each front bracket 806, 808 has a front jaw 807, 809 which engages the front strut 150 in rotatable movement therebetween.

Atop the Plexiglas® 850 is mounted a conventional toilet seat 900. This seat may be affixed to the Plexiglas® 850 and to the rear support bar 800 by means of bracket 810. Alternatively, the seat 900 may swing about bar 800 by bracket 810 being a swivel-type hinge. (The Plexiglas® sheet 850 need not be used. As such the front end of the toilet seat 900 may rest on the underlying struts 110, 120, 130.)

Figure 3:
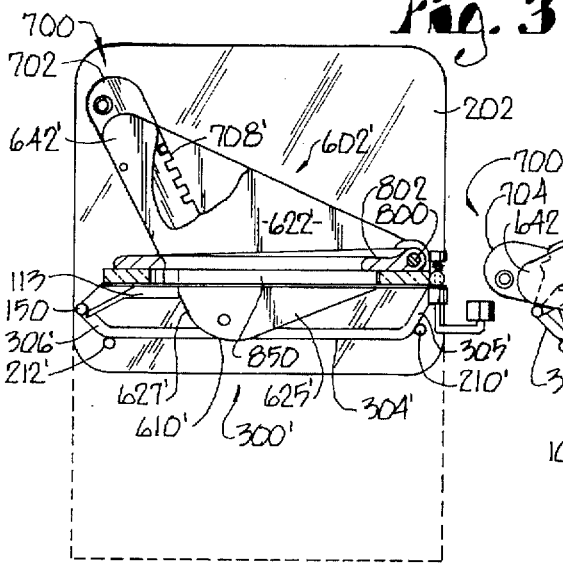
FIG. 3 is a view of the far lateral side of the toilet seat structure with the intermediate toilet seat being in a conventional horizontal position and the partially shown lift bar being in its elevated position, the structure having a Plexiglas® side panel connected thereto and showing in phantom lines an alternative extension of the side panel for floor support.
Figure 4:
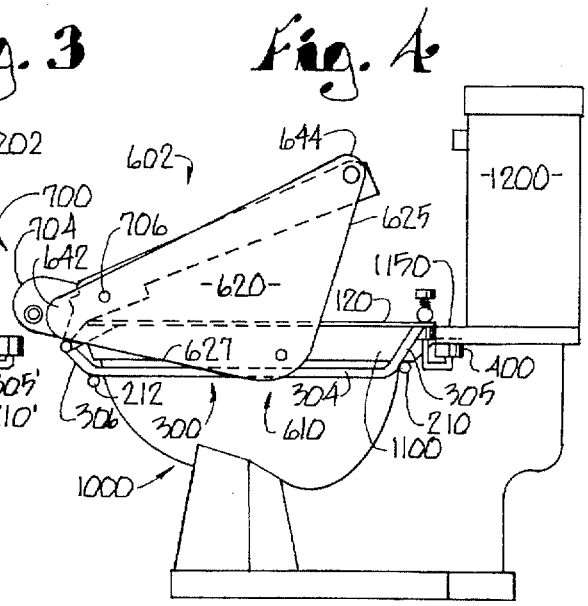
FIG. 4 is a side elevation view of the toilet seat of FIG.1 on a toilet bowl showing the near lateral side of the toilet seat structure with the side panels removed and illustrating the lift bar in a lowered position with the phantom-lined toilet seat being in its angled position relative to the underlying toilet bowl.

Engagement of the panels 602, 602' with the respective rails 300, 300' at fulcrum zones 610, 610' allows for a pivotal and tangential motion oft he panels 602, 602' relative to the rails 300, 300'. This motion positions the front corner 642 and rear corner 644 of the respective arms 602, 602' at alternative elevated or adjacent positions relative to the rail (FIG. 3, FIG. 4). During such movement, the toilet seat 900 is swung between a first horizontal functional position (FIG. 3) resting atop the underlying framework 110, 120, 130 and a second position at which seat 900 is canted or angled relative to the underlying framework and bowl 1100 (FIG. 4). During such movement the lift bar 700 is elevated above the toilet seat 900 (FIG. 3) or is adjacent the front end of the angled seat (FIG. 4). At these two positions the triangular configuration of the panels 602, 602' is effective in maintaining such positions as the mass of the panels is either rearward (FIG. 3) or forward (FIG. 4) of the zone 610.

In use the conventional toilet seat is removed from the toilet 1000 so that the framework 110, 120, 130 rests atop the toilet bowl rim 1100 with support bar 140 resting atop the portion 1150 of the bowl rearward of rim 1100. The J-clamps 400 are then tightened to the underside of rim 1100 so as to further secure the structure 100 to the bowl 1000. At this position the rails 300, 300' are on the opposed lateral sides of the bowl. The struts 110, 120, 130, 140 are spaced so as to underlie the Plexiglas® 850 and attached toilet seat 900 and not interfere with waste deposit.

FIG. 4 shows the user entry/exit positions of the structure 100 with the front corner 642 of the panels or arms 602, 602' being generally adjacent the front end of the toilet bowl rim 1100. This position is achieved by the exertion of downward pressure on the lift bar 700. This pressure causes each panel 602, 602' to pivot about its fulcrum 610 and tangentially slide rearwardly along the respective rail 300, 300'. This movement causes a downward displacement of the front corner 642 and elevation of the rear corner 644 of each arm 602, 602'. Concurrently, the front end of the Plexiglas® 850 is swung about the front support bar 150 as provided by jaws 807, 809 of brackets 806, 808. Concurrently, the rear end of the Plexiglas® 850 and attached seat 900 are displaced above the underlying framework 110, 120, 130 to achieve the FIG. 4 angled position. The position of the lift bar 700 adjacent the toilet bowl rim 1100 thus diminishes interference with user entry or exit from the structure 100.

Upon the user sitting on the canted seat 900 the weight of the user will downwardly displace the rear ends of the Plexiglas® 850 and seat 900. This movement causes a pivotal and forward tangential movement of each panel 602, 602' about its fulcrum 610, 610' relative to rails 300, 300'. Thus, the rear corner 644 of each panel is downwardly displaced while the lift bar 700 extending between the front corners 642, 642' of arms 602, 602' is swung to its FIG. 3 position. As the upper legs of the seated user are extended over this lift bar 700, the upper legs of the user are drawn towards the seated user's torso. This leg/torso relationship moves the seated user into a desired, physiological "squatting" position.

To effect a user exit, downward pressure by the user on the lift bar 700 again causes each panel 602, 602' to pivot and tangentially move (rearwardly) along the respective rail 300, 300'. During this movement the rear end of the Plexiglas® 850 and toilet seat 900 are swung to the FIG. 4 position. Thus, the angled seat 900 and downwardly displaced lift bar 700 assists the exit of the user from the structure 100.

Figure 5:
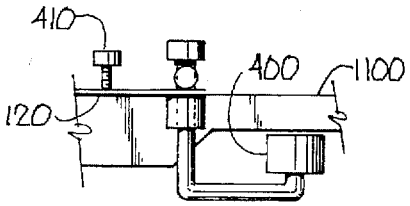
FIG. 5 is a fragmentary view, on an enlarged scale, showing the J-clamps and seat riser at the rear of the toilet seat prior to engagement with the conventional toilet bowl.

It is also noted that vertical belts 410 may be positioned at the rear ends of each strut 110, 120 for contact with the Plexiglas® 850 (or seat 900 if a sheet 850 is not used) when the seat 900 is in a horizontal FIG. 3 position. Each bolt 410 is threadably adjustable within an aperture 411 between FIG. 5 and 6 positions so that the height of the rear end of the Plexiglas® 850 relative to the toilet bowl rim 1100 can be raised or lowered. This adjustment allows the structure to fit a wide range of users.

Figure 11:
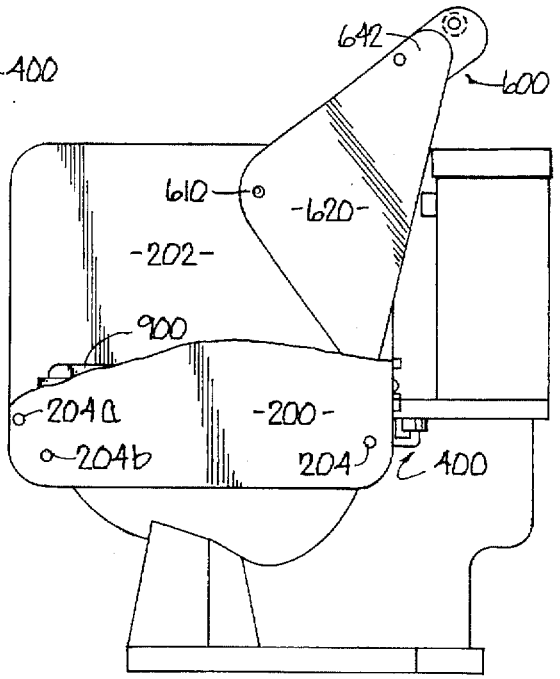
FIG. 11 is a side view of the toilet seat structure of FIG. 1 with a portion of a side support panel being broken away to show the lift bar and side panels being rearwardly swung to a non-functional position so as to allow conventional user access to the toilet seat and underlying bowl.
Figure 17:
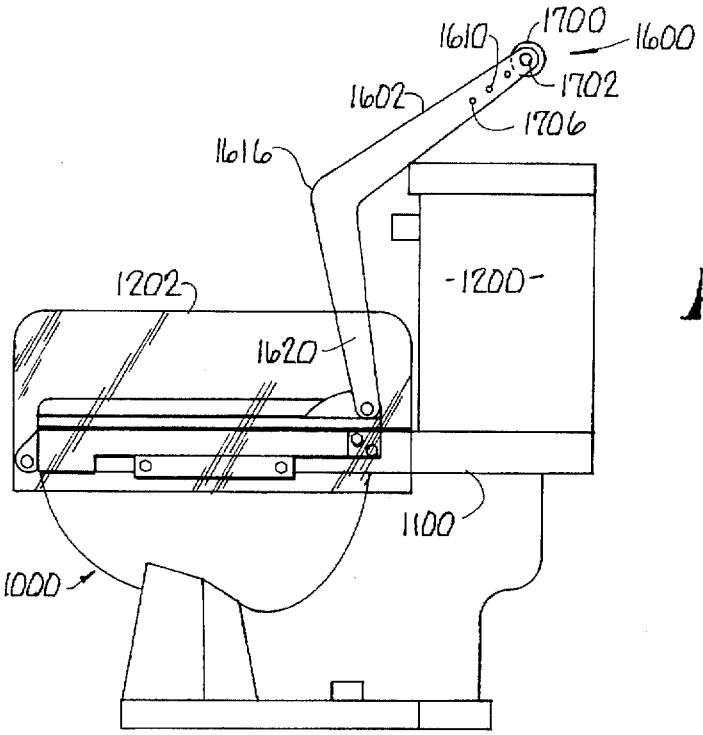
FIG. 17 is a side view of the toilet seat structure of FIG. 15 with the lift bar being swung towards the rear of the toilet bowl so as to allow conventional use of the toilet bowl.

As shown in FIG. 11 the lift bar 700 and side arms 602, 602' may be rearwardly swung about the rear support bar 800 into contact with the water reservoir 1200. At this position the seat 900 remains in a horizontal position atop the bowl 1000 allowing the bowl 1000 to be conventionally used. Also, the entire cradle assembly can be forwardly swung by means of rotatable movement of jaws 807, 809 about bar 150. This position allows access to the underlying framework.

Accordingly, it can be appreciated that the rocking and tangential movement of the panels 602, 602', relative to the rails 300, 300', positions the lift bar 700 and the toilet seat 900 among user entry/exit and a functional "squatting" positions, the rocking movement of the arms 602, 602' being caused by pressure on either the lift bar 700 or the toilet seat 900. Of course, in some instances the user may need assistance from another parson in effecting such a rocking motion as the strength of a user, particularly a geriatric user, may not be enough to initiate this rocking motion.

Figure 9:
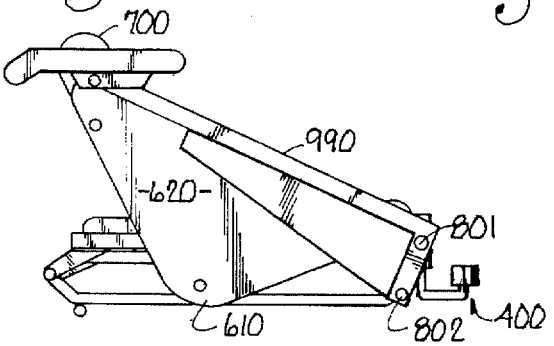
FIG. 9 is a view of the toilet seat structure of FIG. 7 with the seat in a functional horizontal position and showing the use of an alternative arm rest in lieu of the Plexiglas® side panel of FIG. 1.
Figure 10:
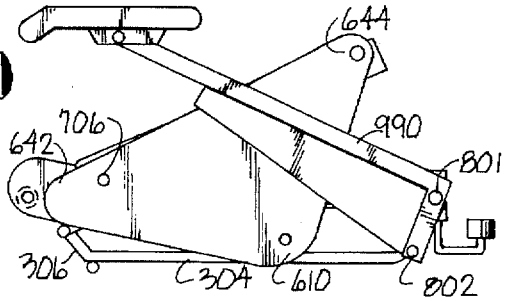
FIG. 10 is a toilet seat device as shown in FIG. 9 showing the toilet seat and lift bar in an entry/exit position.

FIGS. 7–10 illustrate an embodiment, as above described, utilizing a split toilet seat 950 having a curved, rear edge 952 and front 954 edge in lieu of seat 900. The slot 956 at the rear edge 952 of seat 950 diminishes discomfort of the seated user caused by contact of the user's tail bone with the toilet seat. Also, as best shown in FIGS. 9 and 10, alternative arm rest assemblies 990, 990' are utilized in lieu of the panels 200, 202. These arm rests 990, 990' are attached by means of bolts 801 engaging the open ends of the seat support bar 800 and sockets 210. Thus, various side panels and/or toilet seats may be utilized with the structure as herein described.

FIGS. 13–19 illustrate a third embodiment of our invention. As such, the device 1500 again presents a framework comprising first and second longitudinal struts 1510, 1520 with support struts 1530, 1532 traversely extending therebetween. Extending from the bars 1510, 1520, 1530 are horizontal flanges 1560, 1570, 1580 for positioning atop the conventional toilet bowl rim 1100 with the rear strut 1532 being positioned atop the portion 1150 of the bowl adjacent the water reservoir 1200.

Connected by flanges 1542, 1542' to the longitudinal struts 1510, 1520 are a pair of channel-shaped tracks 1540, 1540'. These channels are used in lieu of the tubular rails 300, 300' as previously described. A cradle assembly 1600 presents a pair of boomerang-shaped arms 1602, 1602' having front 1610 and rear ends 1620. Intermediate these ends 1610, 1620 is a fulcrum zone 1616 which is supported within track 1540.

Extending between the front ends 1610 of each arm 1602, 1602' is a lift bar 1700. The ends of the lift bar 1700 may be positioned along the length of the front portions of the arms 1602, 1602' by extension of the lift bar ends 1702, 1704 through selected apertures 1706.

Again, a Plexiglas® sheet 1850 extends between the arms 1602, 1602' by means of brackets 1802, 1804 attached to the rear support bar 1800 which extends between the rear ends 1620 of the respective arms 1602, 1602'. Brackets 1806, 1808 are also attached to the underside of sheet 1850, each bracket having a jaw-like 1807, 1809 end pivotally attached to a front support bar 1530 in a manner as above described.

The toilet seat 900 is attached to sheet 1850 and the rear support bar 1800 by either a fixed or swivel hinge 1892. Accordingly, this seat 900 may be used with or without the Plexiglas® sheet 1850 as above described. Finally, side Plexiglas® support panels 1202, 1204 attach to the sides of the framework. Again the arms 1602, 1602' may be rearwardly swung towards the water reservoir 1200 to allow conventional use of the toilet bowl 1000.

Figure 18:
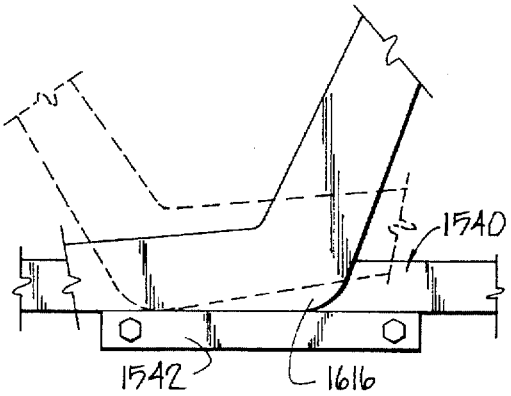
FIG. 18 is an enlarged view of the arms of the toilet device of FIG. 13 showing the arm in an entry/exit first position in solid lines, and a second functional use position in phantom lines, the latter position being forwardly tangentially displaced along the associated rail.
Figure 19:
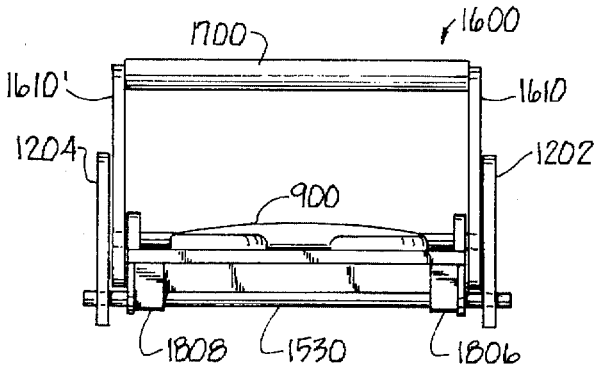
FIG. 19 is a front elevation view of the toilet seat structure of FIG. 15.

Accordingly, the cradle assembly 1600, similar to assembly 600, is presented which moves the seat 900 between a user entry/exit position (FIG. 15) and a seated position (FIG. 16). In this embodiment the fulcrum zones 1616, 1616' of arms 1602, 1602' are positioned within the track-like channels 1540, 1540'. Again, the arms 1602, 1602' pivot about the zones 1610 of contact within the channels and tangentially slide rearwardly or forwardly therealong. The movement of the fulcrum zone 1616 within the tracks is best shown in FIG. 18. This arm movement swings the lift bar 1700 and seat 900 from their FIG. 15 entry positions to the FIG. 16 functional position and return to the FIG. 15 exit positions. The FIG. 16 position draws the legs of the seated user towards the torso so that the users can assume a physiologically effective "squatting" position which is said to enhance bowel movement.

Accordingly, it is understood that various cradle assemblies of the type shown herein 600, 600' may be utilized so as to effect the desired operation of the toilet structure as above described.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A toilet accessory device for positioning a seated user in a functional position atop a toilet bowl with the upper legs of the seated user being drawn towards the user's torso comprising:

framework for placement atop the toilet bowl, the framework including an opening for passage of waste therethrough;

a seat structure for the user;

first and second rail assemblies extending along the lateral edges of said framework for extension along lateral sides of the toilet bowl;

cradle means atop said framework and engaging said rails for user movement of said seat between a first generally horizontal position relative to the toilet bowl and a second position wherein said seat is at an angled position relative to the toilet bowl;

a lift bar traversing a forward portion of said cradle assembly and in extension across a front of the toilet bowl;

said cradle means further positioning said lift bar at a first position above the toilet bowl with said seat in said first position for drawing the legs of a user to a position adjacent the user's torso and a second position downwardly displaced from said first lift bar position upon movement of said seat to said second angled position.

2. The device as claimed in claim 1 wherein said cradle means comprises:

first and second arms, each arm having front and rear ends with a portion therebetween pivotally engaging a respective rail assembly;

means for connecting said seat in swingable movement with said rear ends of said arms;

means for connecting said lift bar between said front ends of said arms.

3. The device as claimed in claim 2 wherein said seat structure further comprises:

a rigid sheet extending between said arms and underlying said seat;

means for affixing a front end of said rigid sheet in swingable movement about a front end of said framework and in movement with said rear ends of said arms.

4. The device as claimed in claim 2 further comprising:

a rear support bar in said framework;

means for pivotally mounting said rear ends of said arms to said rear support bar in a manner to rearwardly swing said arms away from said rail assemblies.

5. The device as claimed in claim 2 wherein said rail assemblies comprise a tubular rail for contact with said portion of said arms.

6. The device as claimed in claim 2 wherein said rail assemblies comprise channel-shaped rails in configuration for contact with said portion of said arms.

7. The device as claimed in claim 2 wherein each of said arms are triangular in configuration presenting first, second and third vertices with said second vertex corresponding to said portion engaging said rail assembly and said first and third vertices corresponding to said front and rear ends.

8. The device as claimed in claim 7 wherein said arm portion tangentially slides along said respective rail during said pivotal movement.

9. The device as claimed in claim 1 wherein said framework comprises:

first and second longitudinal struts for positioning atop the toilet bowl;

at least one support bar traversing said struts for positioning atop the toilet bowl.

10. The device as claimed in claim 9 further comprising at least one clamp attached to a rearward portion of said framework for connection to the toilet bowl.

11. A toilet accessory device for positioning a seated user in a functional position atop a toilet bowl with the upper legs of the seated user being drawn towards the user's torso comprising:

a framework for support atop a conventional rim of the toilet bowl, the framework including an opening for passage of waste therethrough;

a seat for the user;

first and second rail assemblies extending along the lateral edges of said framework for extension along lateral sides of the toilet bowl;

first and second arms having front and rear ends, each of said arms having an intermediate portion for pivotally engaging said rail assemblies, said arms pivotal between a first position with said front ends adjacent said framework with said rear ends elevated above said front ends and a second position having said front ends elevated above said framework with said rear ends below said front ends;

means for connecting said seat between said arms whereupon movement of said rear arm ends between said first and second positions moves said seat between an angled position relative to said framework and a generally horizontal position relative to the toilet bowl;

a lift bar extending between said front ends of said first and second arms, whereupon movement of said front arm ends between said first and second positions swings said lift bar to a position adjacent said framework to a position elevated therefrom, said elevated position drawing the legs of the user on said seat towards a user's torso.

12. The device as claimed in claim 11 wherein said seat connecting means comprises:

a rear support bar extending between said rear ends of said arms;

means for connecting a rear end of said seat to said support bar;

a front support bar in said framework traversing a front end of said seat;

means for connecting said front end of said seat in pivotal movement about said front support bar.

13. The device as claimed in claim 11 wherein said seat connecting means comprises:

a rear support bar extending between said rear ends of said arms;

a material sheet having an opening;

means for connecting a rear end of said sheet to said rear support bar;

a front support bar in said framework traversing a front end of said sheet;

means for connecting said front end of said sheet in pivotal movement about said front support bar;

said seat mounted to said sheet, whereupon said sheet is in swingable movement with said rear arm ends.

14. A toilet accessory device for positioning a seated user in a functional position atop a toilet bowl with the upper legs of the seated user being drawn towards the user's torso comprising:

a framework for placement atop the toilet bowl, the framework including an opening for passage of waste therethrough;

a seat for the user;

first and second rails extending along the lateral edges of said framework for extension along lateral sides of the toilet bowl;

a pair of side arms pivotally engageable with said rails, said side arms having front and rear ends alternatively movable between a first position with said front ends adjacent the rails and a second position with the front ends displaced from the rails;

means for mounting said seat between said side arms whereupon said seat is in a generally horizontal position at said second arm position and an angled position at said first position.

15. The device as claimed in claim 14 further comprising:

a lift bar;

means for mounting said lift bar between said front ends of said side arms whereupon said lift bar is adjacent the toilet bowl at said first position and elevated above the toilet bowl at said second position, said elevated lift bar position drawing the legs of a user on said horizontal seat towards the seated user's torso.

16. The device as claimed in claim 15 wherein said lift bar mounting means comprises a pair of arms selectably extendable from said side arms, said lift bar mounted between said extendable arms.

17. The device as claimed in claim 14 wherein each of said side arms comprises front and rear ends with an intermediate portion in said pivotal engagement with said rails.

18. The device as claimed in claim 17 wherein said arms are generally triangular in configuration, said arms having a vertex presenting said intermediate portion in said pivotal engagement with said rails.

19. The device as claimed in claim 17 wherein said intermediate portion tangentially slides along said rails during said pivotal engagement.

20. The device as claimed in claim 14 further comprising means associated with said framework for adjusting a height of said seat above said framework at said generally horizontal position.

* * * * *

UNITED STATES PATENT AND TRADEMARK OFFICE

CERTIFICATE OF CORRECTION

PATENT NO. : 5,666,673

DATED : September 16, 1997

INVENTOR(S) : Francis J. Ammatelli and Edward L. McMullen

It is certified that error appears in the above-identified patent and that said Letters Patent is hereby corrected as shown below:

Column 7, line 36, delete "rails" and substitute --rail assemblies--.

Column 8, line 18, after "rail" insert --assembly--.

Column 8, line 43, after "arms" insert --user--.

Signed and Sealed this

Twenty-third Day of December, 1997

Bruce Lehman

*Attest:*

BRUCE LEHMAN

*Attesting Officer*

*Commissioner of Patents and Trademarks*